US007325711B2

(12) United States Patent
Schiestl et al.

(10) Patent No.: US 7,325,711 B2
(45) Date of Patent: Feb. 5, 2008

(54) ELECTRICALLY OPERATED DRIVE-IN TOOL

(75) Inventors: Ulrich Schiestl, Feldkirch (AT); Peter Stauss, Feldkirch (AT)

(73) Assignee: Hilti Aktiengeseleschaft, Schaan (LI)

( * ) Notice: Subject to any disclaimer, the term of this patent is extended or adjusted under 35 U.S.C. 154(b) by 0 days.

(21) Appl. No.: 11/402,407

(22) Filed: Apr. 11, 2006

(65) Prior Publication Data

US 2006/0261126 A1 Nov. 23, 2006

(30) Foreign Application Priority Data

May 18, 2005 (DE) ..... 10 2005 000 061

(51) Int. Cl.
*B25C 5/06* (2006.01)

(52) U.S. Cl. ..... 227/131; 227/133

(58) Field of Classification Search ..... 227/131–133, 227/2, 8

See application file for complete search history.

(56) References Cited

U.S. PATENT DOCUMENTS 4,129,240 A * 12/1978 Geist ..... 227/8
4,204,622 A * 5/1980 Smith et al. ..... 227/7
4,323,127 A * 4/1982 Cunningham ..... 173/53
4,449,660 A * 5/1984 Smith, III ..... 227/8
4,721,170 A * 1/1988 Rees ..... 173/13
4,747,455 A * 5/1988 Cunningham ..... 173/1
4,964,558 A * 10/1990 Crutcher et al. ..... 227/8
5,098,004 A * 3/1992 Kerrigan ..... 227/134
5,118,023 A * 6/1992 Fushiya et al. ..... 227/8
5,511,715 A * 4/1996 Crutcher et al. ..... 227/131
6,604,666 B1 * 8/2003 Pedicini et al. ..... 227/131
6,607,111 B2 * 8/2003 Garvis et al. ..... 227/131
6,705,503 B1 * 3/2004 Pedicini et al. ..... 227/131
6,766,935 B2 * 7/2004 Pedicini et al. ..... 227/131
2002/0053587 A1 * 5/2002 White et al. ..... 227/131
2003/0192934 A1 * 10/2003 Pedicini et al. ..... 227/131
2004/0232194 A1 * 11/2004 Pedicini et al. ..... 227/131
2005/0218186 A1 * 10/2005 Forster ..... 227/133
2005/0224552 A1 * 10/2005 Berry et al. ..... 227/131
2006/0261127 A1 * 11/2006 Wolf et al. ..... 227/131

* cited by examiner

*Primary Examiner*—Stephen F. Gerrity
(74) *Attorney, Agent, or Firm*—Abelman, Frayne & Schwab

(57) ABSTRACT

A drive-in tool drives in fastening elements and includes a driving ram and a drive unit. The driving ram is displaceably supported in a guide. The drive unit has a drive flywheel and a return device. The drive flywheel is set in rotation by an electric motor, and the return device displaces the driving ram from an initial position after the completion of the drive-in process. The return device has a return motor separate from the electric motor, and the return motor is connected to the driving ram by a return mechanism.

7 Claims, 2 Drawing Sheets

ELECTRICALLY OPERATED DRIVE-IN TOOL

BACKGROUND OF THE INVENTION

1. Field of the Invention

The invention is directed to an electrically operated drive-in tool having a ram for driving in a fastening element and supported in a guide for displacement therein, a drive unit for driving the ram and having at least one flywheel driven by an electric motor, and a return device for returning the ram in its initial position upon completion of the drive-in process. In drive-in tools of this type, fastening elements are driven into a substrate by a driving movement of the driving ram.

2. Description of the Prior Art

In the electrically operated drive-in tools, the driving ram is accelerated by at least one flywheel which can be driven by an electric motor. In drive-in tools which draw their energy from a battery, the driving energy is approximately 35 J to 40 J. According to the flywheel principle realized in the drive-in tools, the energy stored in the flywheel is transmitted to the driving ram by a clutch. This clutch must be switched very quickly and must transmit a very high energy within a very short time. Further, the clutch must be switched off again very quickly at the end of the drive-in process. The driving piston is moved back at the end of the drive-in process, e.g., by a spring element or a flexible belt.

U.S. Pat. No. 4,721,170 discloses an electric drive-in tool in which the driving ram is guided through between a flywheel, which is driven by an electric motor, and an idler wheel. A flexible belt which acts on the driving ram, on one hand, and is held at the housing, on the other hand is provided for returning the driving ram to its initial position after a drive-in process has been completed.

However, returning the driving ram with a flexible belt is only practical in drive-in tools with low setting power. In drive-in tools with higher driving energies for the driving ram greater than about 35 J, the life of the flexible belt is drastically reduced.

U.S. Pat. No. 4,129,240 discloses another electric drive-in tool in which a driving ram can be driven by a flywheel which is driven by an electric motor. A return device for the driving ram comprises a return wheel that is held at a supporting arm. This return wheel is switchable between an active position, in which it is driven by a shaft of the flywheel and engages the driving ram, and an inactive position in which it is lifted from the driving ram and is not driven by the shaft of the flywheel.

This is disadvantageous in that the mechanism for switching the return wheel is very complicated and slow.

Further, it is known from U.S. Pat. No. 4,129,240 to return the driving ram with a return spring which engages the housing, on one hand, and the driving ram, on the other hand. The drawback of the device of this U.S. Patent consists that the mechanical return spring does not have the required useful life in drive-in tools with a setting power greater than about 35 J. Further, the mass of the spring leads to drastic energy losses.

SUMMARY OF THE INVENTION

It is the object of the present invention to develop a drive-in tool of the type mentioned above which insures a reliable return of the driving ram at higher driving energies, greater than 35 J, and which has an adequate useful life.

This and other objects of the present invention, which will become apparent hereinafter, are achieved by providing a return device having a return motor which is connected with the driving ram by a return mechanism. This return motor which is not dependent on the electric motor of the drive unit enables a flexible control of the ram return. Further, the return mechanism can slip or disengage during the drive-in process so that there is no loss of energy as there is with a return spring. Further, the return device according to the invention has a longer life and is less prone to malfunction. The return motor can be formed as a rotary motor or as a linear motor.

It is advantageous when the return motor has an output in the range of 0.1% to 20% of the output of the electric motor that drives the flywheel. Typical electric drive motors for drive-in tools have a power requirement of about 150 W to 400 W. Due to its relatively low power consumption, the return motor has sufficient energy available because its power consumption is practically negligible compared to that of the flywheel drive motor. Further, in view of its low power consumption, the return motor can be an inexpensive small motor so that the production costs for the drive-in tool can be kept low.

The return motor is advantageously formed as a servomotor having an output of 2 W to 50 W. A wide variety of servomotors of this kind are available as standard components.

Further, it is advantageous when the return device has at least one switching mechanism for detecting an end position of the driving ram opposite the starting position. The return device can be put into operation in a simple manner by this switching mechanism when the driving ram is in its end position at the end of a drive-in process.

Further, it is advantageous when the return device has at least one further switching mechanism for detecting the initial position of the driving ram. In this way, the return device can be switched off in a simple manner when the driving ram has been moved by the return device to its initial position again. If a second switching mechanism of this kind is not provided, the return device can also be switched off in a time-controlled manner, for example.

The switching mechanism or all switching mechanisms is/are advantageously connected to a control unit by a control conductor. The signals of the switching mechanisms can be linked to other control parameters by a control unit, and an optimal control of the return device can be achieved in this way. For example, the control unit can check, e.g., in addition, before switching on the return device, whether or not the contact pressing means is already lifted from the driving ram in order to deactivate the drive coupling to the drive flywheel.

It is also advantageous when the return mechanism is formed as a return roller or as a friction wheel. This friction wheel can be freewheeling in the driving direction of the piston in order to prevent energy losses in the driving ram during the setting process. A friction wheel is economical and is well suited for transmitting the necessary return forces to the driving ram.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
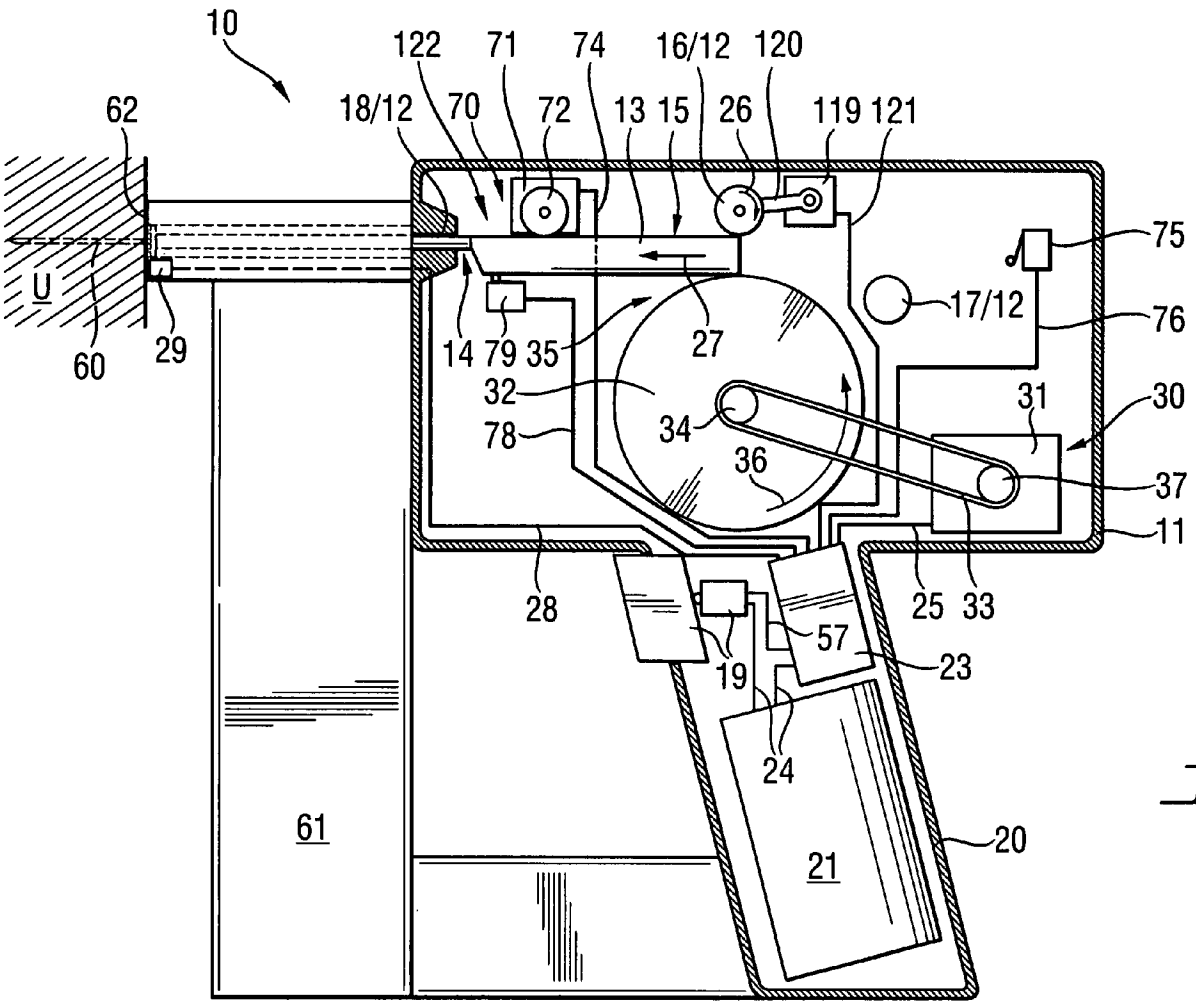
FIG. 1 shows a longitudinal cross-sectional view of a drive-in tool according to the present invention in an actuated position.
Figure 2:
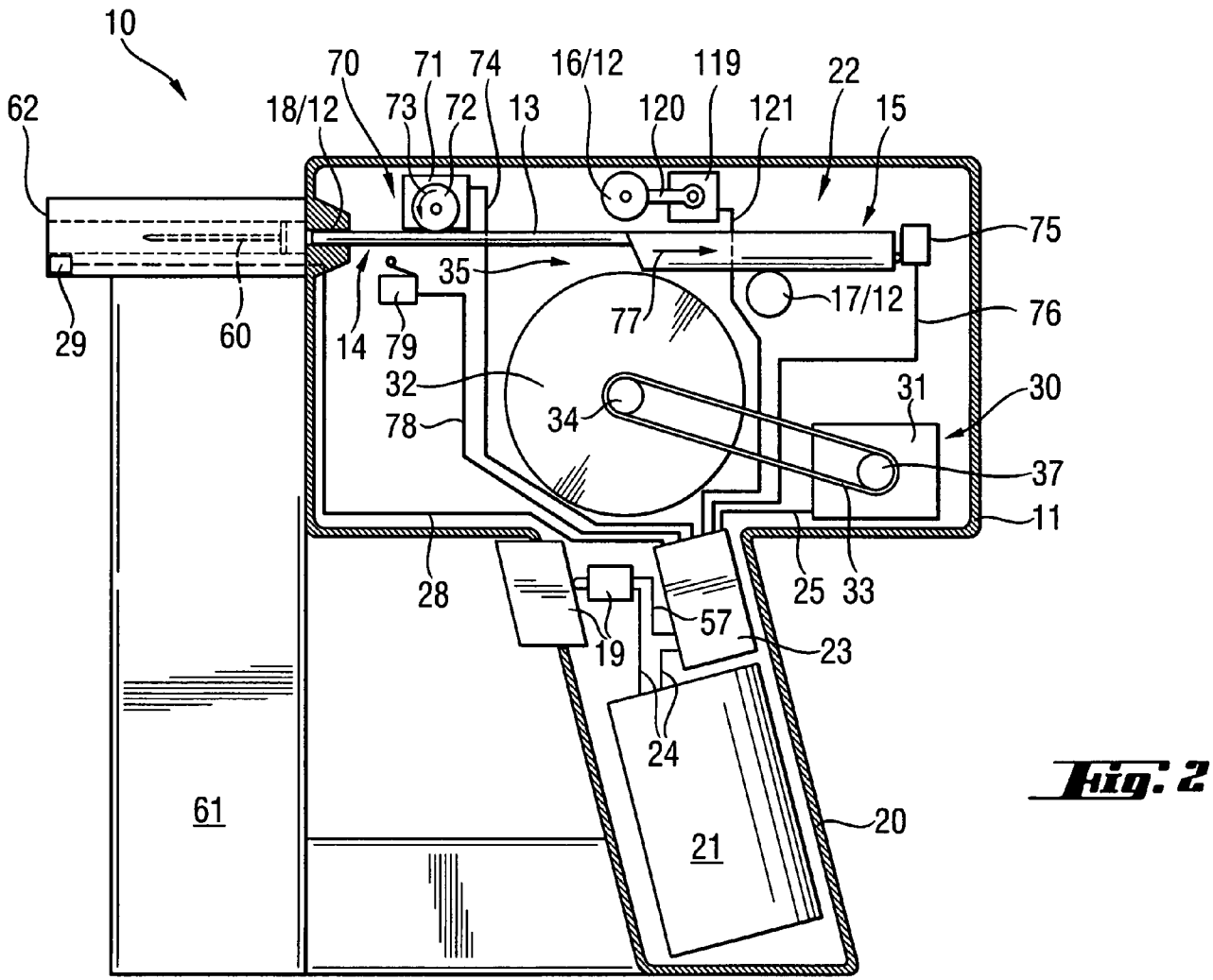
FIG. 2 shows a view similar to that of FIG. 1, with the driving ram returned to its initial position.

The drive-in tool 10, which is shown in FIGS. 1 and 2, has a housing 11 and a drive unit, designated in its entirety with a reference numeral 30 and which is arranged in the housing 11 for driving a driving ram 13 which displaceable in a guide 12. The guide 12 has a guide roller 17, contact pressing means 16 which is formed as a contact pressing roller, and a guide channel 18. A fastening element magazine 61, in which fastening elements 60 are loaded, is arranged at the end of the guide 12 in the driving direction 27 so as to project laterally therefrom.

Further, the drive-in tool 10 has a handle 20 on which a trigger switch 19 is arranged for triggering a drive-in process with the drive-in tool 10. A power supply, designated in its entirety by 21, is arranged in the handle 20 and supplies the drive-in tool 10 with electrical energy. The power supply 21 has at least one battery in the present case. The power supply 21 is connected to a control unit 23 and to the trigger switch 19 by power conductors 24. Further, the control unit 23 is connected to the trigger switch 19 with a switch conductor 57.

Another switch means 29 is arranged at a mouth 62 of the drive-in tool 10 and is electrically connected to the control unit 23 by a conductor 28. The switch means 29 transmits an electric signal to the control unit 23 as soon as the drive-in tool 10 is pressed against a substrate U, as can be seen from FIG. 1, and accordingly ensures that the drive-in tool 10 can only be triggered when it has been pressed against a constructional component U in the proper manner.

The drive unit 30 comprises an electrically operated motor 31 with a motor shaft 37. The motor shaft 37 transmits a rotational movement of the motor 31 to a bearing pin 34 of a drive flywheel 32 by transmission means 33 which is formed, e.g., as a belt and sets the drive flywheel 32 in rotational movement in the direction indicated by arrow 36. The motor 31 is supplied and switched directly by the control unit 23 via an electric motor conductor 25. For example, the motor 31 can be put into operation by the control unit 23 already when the drive-in tool 10 is pressed against a constructional component U and a corresponding signal is sent from the switch means 29 to the control unit 23 via the conductor 28. Further, a drive coupling 35, which is formed as a friction clutch, acts between the drive flywheel 32 and the driving ram 13. This drive coupling 35 comprises a coupling section 15 of the driving ram 13 which is wider than a front driving section 14 and which can be brought into frictional engagement with the drive flywheel 32 by the contact pressing means 16. The contact pressing means 16 is rotatably supported on a bearing arm 120 which can be raised or lowered by actuating means 119 formed, e.g., as a servomotor, stepping motor or solenoid. The actuating means 119 is connected to the control unit 23 by a control conductor 121. During a movement of the driving ram 13, the contact pressing means 16 can rotate in the direction indicated by arrow 26 and can roll on the driving ram 13 so as not to brake the latter.

Further, a return device, designated in its entirety by 70, is arranged in the drive-in tool 10. This return device 70 includes a return motor 71 which drives the return roller 72 that is formed as a friction wheel. Alternatively, the return roller can also be formed, e.g., as a toothed wheel which cooperates with a toothing at the driving ram. The return motor 71 is electrically connected to the control unit 23 by a conductor 74 and can be actuated by the control unit 23 when the driving ram 13 is in its end position 122 in the driving direction 27. The return device 70 has a first switching mechanism 79 and a second switching mechanism 75 each connected to the control unit 23 by a first control conductor 78 and a second control conductor 76, respectively. The second switching mechanism 75 detects the driving ram 13 in its starting position 22, shown in FIG. 2, while the first switching mechanism 79 detects the driving ram 13 in its end position 122 in the driving direction 27 as can be seen in FIG. 1. Corresponding signals are then sent to the control unit 23 by the first and second switching mechanisms 79, 75 via the first and second control conductors 78 and 76. During operation, the return roller 72, driven by the return motor 71, rotates in the direction indicated by arrow 73 (see FIG. 2) in order to move the driving ram in the return direction 77.

When the drive-in tool 10 is pressed against a constructional component U, as can be seen in FIG. 1, the motor 31 of the drive unit 30 is initially switched on by the switch means 29 and the control unit 23, and the drive flywheel 32 is set in rotation in the rotational direction indicated by arrow 36 (see FIG. 2) by the motor 31.

When the trigger switch 19 is subsequently actuated by an operator, the actuating means 119 are activated by the control unit 23 via the control conductor 121. The contact pressing means 16 at the bearing arm 120 is then moved in the direction of the driving ram 13 by the actuating means 119. The driving ram 13 is accordingly moved to the drive flywheel 32 with its coupling section 15 so that the drive coupling 35 becomes engaged and the driving ram 13 is accelerated in the driving direction by the drive flywheel 32. At the end of the movement of the driving ram 13, the coupling section 15 strikes the first switching mechanism 79. The first switching mechanism 79 then sends a signal, via the first control conductor 78, to the control unit 23 which in turn, via the control conductor 121, causes the actuating means 119 to lift the contact pressing means 16 from the driving ram 13 in order to deactivate the drive coupling 35 (see FIG. 2). Further, via the control conductor 74, the control unit 23 actuates the return motor 71 of the return device 70 which then rotates in direction of arrow 73 so as to move the driving ram 13 in the return direction 77 until the coupling section 15 of the driving ram 13 runs against the second switching mechanism 75. The second switching mechanism 75 then transmits a control signal, via the second control conductor 76, to the control unit 23 which then switches off the return motor 71 via conductor 74. The driving ram 13 is now located in its initial position 22 in which it is possible to carry out a new drive-in process.

Though the present invention was shown and described with references to the preferred embodiment, such is merely illustrative of the present invention and is not to be construed as a limitation thereof and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. An electrically operated drive-in tool for driving-in fastening elements, comprising:

a guide (12);

a ram (13) displaceably supported in the guide (12) for driving the fastening elements;

a drive unit (30) for driving the ram (13) and including:

a drive flywheel (32); and an electric motor (31) for rotating the drive flywheel (32); and a return device (70) for displacing the driving ram (13) to an initial position thereof and having:

a return motor (71) separate from the electric motor (31); and return means for connecting the return motor (71) to the driving ram (13).

2. A drive-in tool according to claim 1, wherein the return motor (71) has a power output in the range of 0.1% to 20% of the output of the electric motor (31).

3. A drive-in tool according to claim 1, wherein the return motor (71) is formed as a servomotor having a power output in the range of about 2 W to about 50 W.

4. A drive-in tool according to claim 1, wherein the return device (70) has at least one first switching mechanism (79) for detecting an end position (122) of the driving ram (13) upon completion of a drive-in process.

5. A drive-in tool according to claim 4, wherein the return device (70) has at least one second switching mechanism (75) for detecting an initial position (22) of the driving ram (13).

6. A drive-in tool according to claim 5, wherein each of the switching mechanisms (75, 79) is connected to a control unit by a respective control conductor (76, 78).

7. A drive-in tool according to claim 1, wherein the return means is formed as a return roller (72).

* * * * *